United States Patent [19]

Ostgaard

[11] 4,372,707

[45] Feb. 8, 1983

[54] PILE INSTALLATION AND REMOVAL MECHANISMS IN OFF-SHORE RIGS AND METHOD OF USING SAME

[75] Inventor: John T. Ostgaard, Los Angeles, Calif.

[73] Assignee: Pipe Technology Systems, Inc., Ingleside, Tex.

[21] Appl. No.: 226,521

[22] Filed: Jan. 19, 1981

Related U.S. Application Data

[63] Continuation-in-part of Ser. No. 98,505, Nov. 29, 1979, and a continuation-in-part of Ser. No. 3,593, Jan. 15, 1979, Pat. No. 4,257,720.

[51] Int. Cl.[3] ..... E02B 17/00

[52] U.S. Cl. ..... 405/224; 254/29 R; 254/106; 405/199; 405/228; 405/232

[58] Field of Search ..... 405/195-200, 405/224-228, 232; 254/29 R, 106, 107; 269/48.1

[56] References Cited

U.S. PATENT DOCUMENTS

| | | | |
|---|---|---|---|
| 2,209,660 | 7/1940 | Oka | 254/29 R |
| 2,841,961 | 7/1958 | Lucas | 405/199 |
| 2,984,075 | 5/1961 | Suderow | 405/197 |
| 3,008,691 | 11/1961 | Steele et al. | 405/198 X |
| 3,396,945 | 8/1968 | Schreier et al. | 405/199 X |
| 3,502,159 | 3/1970 | Pogonowski | 405/228 X |
| 3,847,230 | 11/1974 | Blomquist | 405/232 X |
| 3,869,003 | 3/1975 | Yamada et al. | 254/29 R |
| 3,902,326 | 9/1975 | Langenbach | 254/29 X |
| 4,069,681 | 1/1978 | Mott | 405/227 |

*Primary Examiner*—Dennis L. Taylor

*Attorney, Agent, or Firm*—Fulwider, Patton, Rieber, Lee & Utecht

[57] ABSTRACT

A temporary rig of the jack-up type for oil and gas exploration. The rig is towed to a selected site where the legs are lowered to the ocean floor and the deck is raised out of the water. Piles are then pushed into the ocean floor by a series of extensions of hydraulic jacks to anchor the legs. The piles can be pulled up by contracting the jacks in a similar manner so that the rig can be moved to a new location. The jacking mechanisms move within pile guides that form parts of the legs.

12 Claims, 11 Drawing Figures

PILE INSTALLATION AND REMOVAL MECHANISMS IN OFF-SHORE RIGS AND METHOD OF USING SAME

RELATED APPLICATIONS

This is a continuation-in-part of the inventor's application Ser. No. 98,505, entitled "Apparatus and Method for Under-Water Jacking of Piles", filed on Nov. 29, 1979, and is a continuation-in-part of the inventor's application Ser. No. 3,593, entitled "Apparatus and Method for Driving Members into the Ocean Floor", filed Jan. 15, 1979 now U.S. Pat. No. 4,257,720.

FIELD OF THE INVENTION

The present invention relates to temporary off-shore oil and gas exploration rigs, and, more particularly, to a method and apparatus for anchoring and removing such rigs.

BACKGROUND OF THE INVENTION

When exploring a prospective off-shore oil or gas field, it is customary to use a temporary, portable drilling and production rig of a type commonly known as a jack-up rig. These rigs usually have a floatable deck structure and three or four legs that can be raised and lowered relative to the deck. Thus, the rig can be floated to the drilling site where the legs are lowered to the ocean floor and the deck is raised above the water surface. Ballast tanks carried by the deck are then filled to increase the weight of the rig and thereby set the legs.

Temporary rigs most often rest on spud cans, which are large tank-like structures secured to the bottom ends of the legs. Alternatively, a "mat" may be used, this being a structure that joins the bottom ends of the legs and likewise rests on the ocean floor.

One problem associated with conventional jack-up rigs is that the spud cans tend to sink into the ocean floor, particularly if the rig is left in one position for a long period. It is then extremely difficult to raise the spud cans or mat and float the rig, even after the ballast tanks have been emptied.

Another problem that has potentially more serious consequences arises from the fact that one or more of the spud cans will sometimes break through the strata on which a rig initially rests and sink rapidly to the next high density strata. The rig can then start to lean precipitously, imposing high bending moments on one or more legs. An extremely dangerous condition results. It has also been found that the action of the water sometimes causes scouring in the area around the legs, washing away the surrounding soil and leading to further instability.

Jack-up rigs used for exploration are moved fairly frequently to drill and sample conditions in different areas, usually after one to six months at a single location. It has not been practical in the past to anchor them in the manner of permanent towers that remain in place for periods of several years or longer. These permanent towers are anchored by piles driven along or through the tower legs into the soil below. Usually the piles are driven by an air or hydraulically operated hammer held by a crane on the deck of the tower. More recently, underwater hammers have also been used for this purpose. Anchoring a permanent tower in this way is highly time-consuming and expensive, even in relatively shallow water, and the tower is not usually or readily removed and relocated.

An objective of the present invention is to overcome the above problems by adapting temporary rigs to be anchored by piles. A further objective is to use such piles in a manner that is compatible with the temporary and portable nature of the rigs, thus overcoming the previous objections to the use of piles for this purpose.

SUMMARY OF THE INVENTION

According to the method and apparatus of the invention, a temporary off-shore rig of the jack-up type is towed to an exploration site, the rig having a conventional deck structure attached to three or more legs on which it is to be supported. Preferably, each leg includes a plurality of pile guides, which can also serve as load bearing columns. Within each guide is a pile and a hydraulic jack disposed above the pile.

Once the rig has been positioned so that the foot of each leg rests on the ocean floor, the jacks are extended to push the piles into the soil below. The force required to drive the piles can be monitored and recorded. It is preferable to extend jacks associated with different legs simultaneously to balance the load on the rig.

The most effective technique for achieving penetration by the piles is to use slip mechanisms in conjunction with the jacks, enabling the jacks to be secured to the guides at selected locations. Preferably the guides are tubular to be readily engaged by the slip mechanisms.

After the first extension of the jacks, they are contracted and resecured to the guides. Then the jacks are extended again to push the piles further into the ocean floor. This procedure is repeated until the piles have reached the desired depth.

To retract a pile when it is desired to move the tower, the top end of the jack is secured to the guides while the jack is extended. Then the jack is contracted, pulling the pile behind it. The jack is extended, resecured to the guide and contracted again. This process is repeated until the pile has again assumed its original position fully inside the corresponding guide. As in the case of piles being pushed down into the ocean floor, piles should be withdrawn in sets to balance the load.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

A temporary rig 10 for off-shore oil and gas well exploration, constructed in accordance with the present invention and shown in FIGS. 1–8, includes a triangular deck structure 12 and three generally vertical legs 14. A three-leg tower 10 is preferred because of its inherent stability and the relative ease of positioning it, but four or more legs can be used, particularly for larger rigs.

Figure 1:
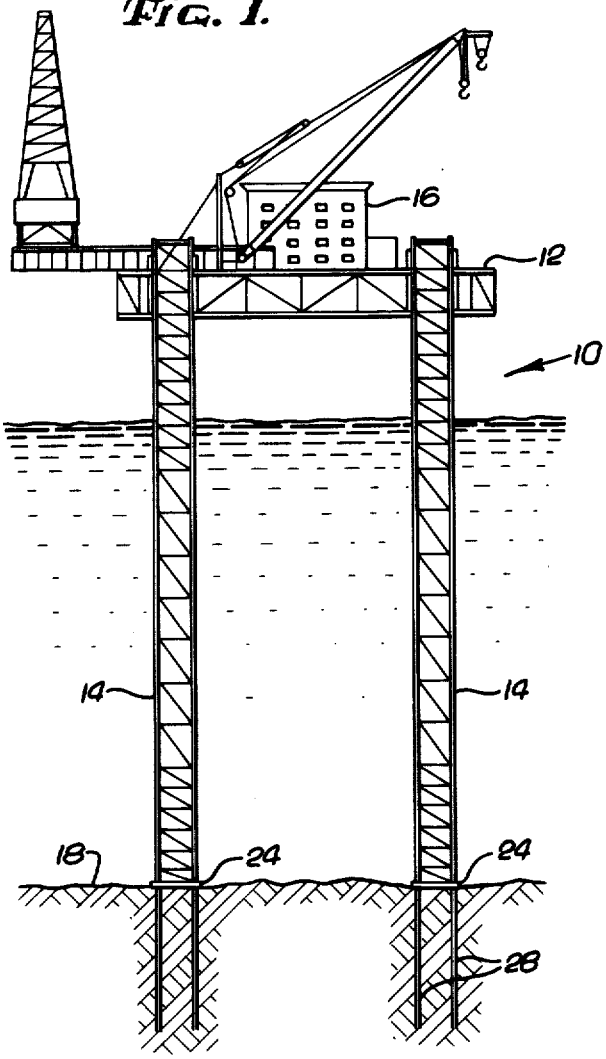
FIG. 1 is a side elevation of a tower of the jack-up rig type constructed in accordance with the present invention, installed at an off-shore location, the deck being positioned near the top of the legs.
Figure 8:
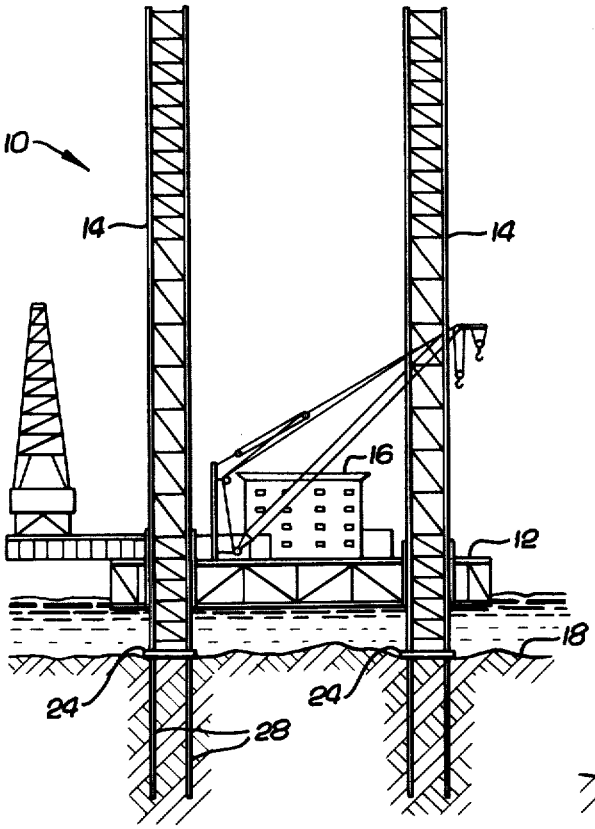
FIG. 8 is a side elevation similar to FIG. 1, but showing the deck near the bottom of the legs to accommodate a low water level.

The deck 12 supports equipment needed for well drilling and for temporary production while the site is tested and evaluated, as shown in FIGS. 1 and 8. It also supports a control station 16 for the pile jacking operation, which includes the necessary controls and instrumentation in a weather-tight habitat. The rig 10 is suitable for use in 30 to 400 feet of water. The height of the deck 12 above the ocean floor 18 is adjustable in the manner of a conventional jack-up rig, using a rack and pinion mechanism (not shown) in connection with each leg 14. FIG. 1 shows the deck 12 near the top ends of the legs 14 to accommodate a high water level, whereas FIG. 8 shows the deck nearer the bottom ends to accommodate a low water level. Since the legs 14 are adjustable individually, compensation can be made for any variation in the underwater terrain.

Figure 3:
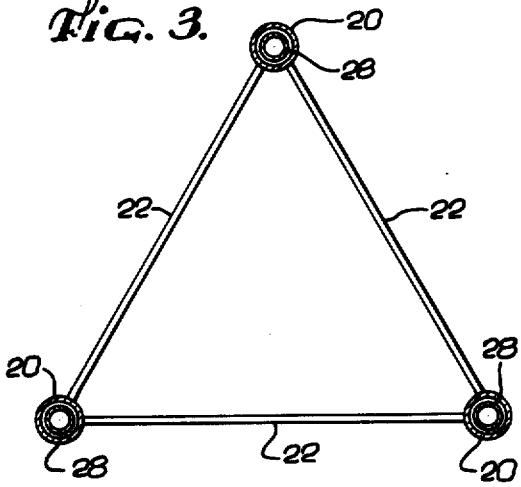
FIG. 3 is a cross-sectional view of the leg taken along the line 3—3 of FIG. 2.

Each leg 14 of this exemplary tower 10 is of basically triangular construction, as best shown in FIG. 3. It includes three tubular steel load-bearing columns 20 typically of 1.0 to 2.5 inches in wall thickness, each column being located at one corner of the triangle. Truss members 22 connect the columns 20 for increased rigidity. If desired, each may have more than three columns, some of which are battered.

Figure 2:
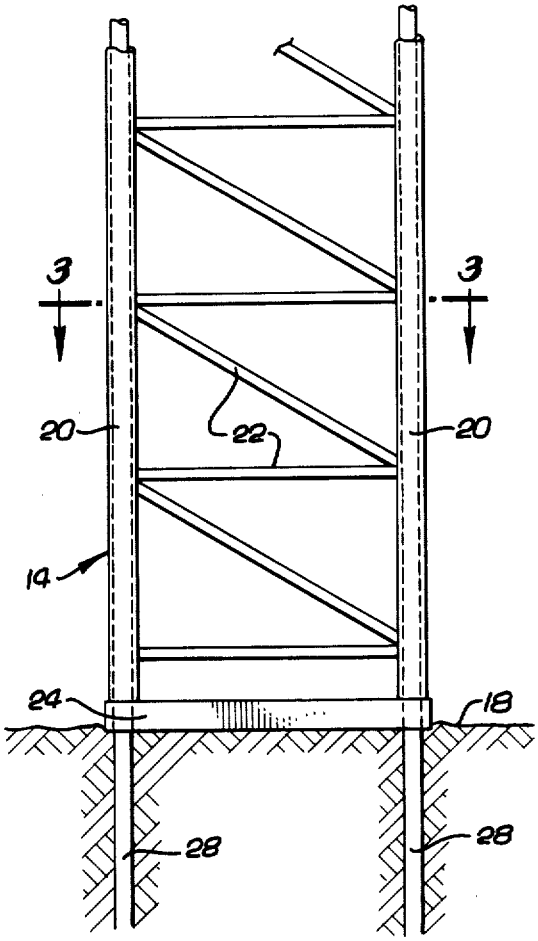
FIG. 2 is an enlarged side elevation of the bottom end of one leg of the tower.

At the bottom of each leg 12 is a foot 24 adapted to rest on the surface of the ocean floor 18. Each foot 24 is generally similar to a conventional spud can but smaller, not extending substantially beyond the outline of the leg 14 itself, as best shown in FIG. 2.

A tubular steel pile 28 is positioned within each column 20 so that the columns serve as pile guides. Typically, a wall thickness of up to 2.5 inches is suitable for 48-inch diameter piles up to 250 feet in length. The minimum length of the pile 28 should be such that about 50 to 70 feet of pile remain in the column 20 when the pile is extended as fully as anticipated. The bottom end of the pile is equipped with a stab-in cone (not shown) so that the pile will not carry a plug of soil internally when withdrawn.

Figure 6:
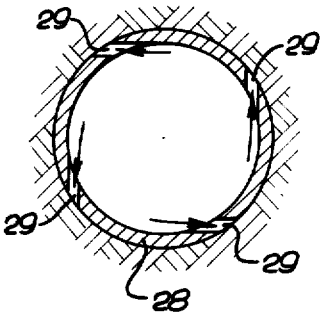
FIG. 6 is a cross-sectional view of the pile taken along the line 6—6 of FIG. 5.

Each pile 28 is provided with two circular arrays of water jet apertures 29 (see FIG. 6). A lower array of apertures 29 is located about 6 feet from the bottom of the leg 12 and the upper array (not shown) is about 21 feet from the bottom. Each aperture 29 is drilled at such an angle that it forms a tangential extension of the cylindrical inner surface of the pile 28. Thus, water that emerges from the apertures 29 under pressure tends to circulate around the pile 28. The pressurized water is supplied by hoses from a high pressure pump on the corresponding jack 30.

Figure 4:
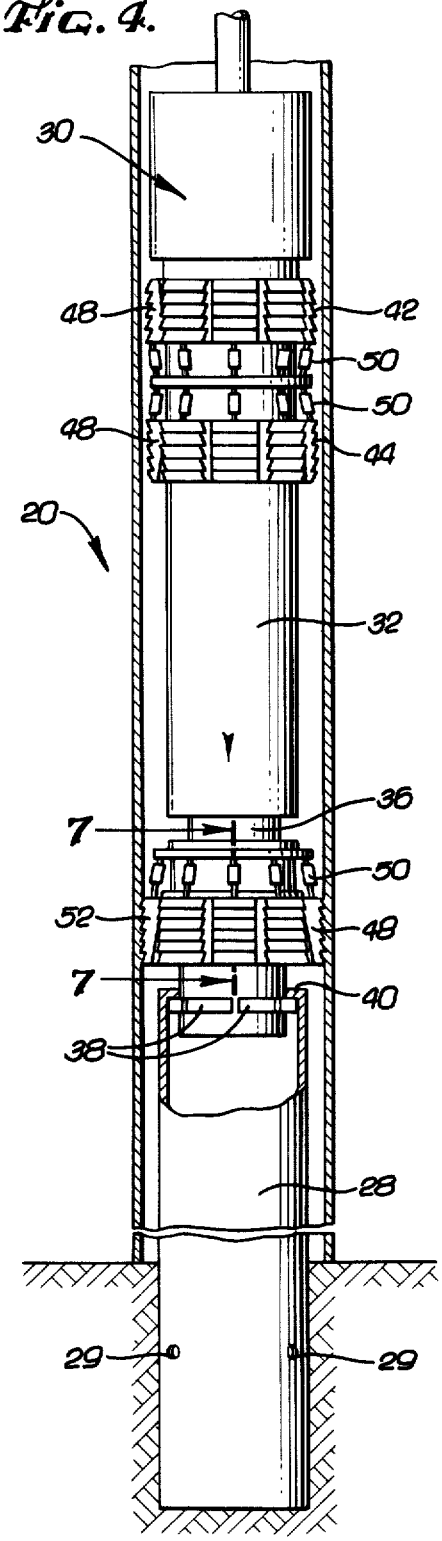
FIG. 4 shows a vertical cross section of one cord of the tower, including a pile and a jack mechanism in a contracted position.
Figure 5:
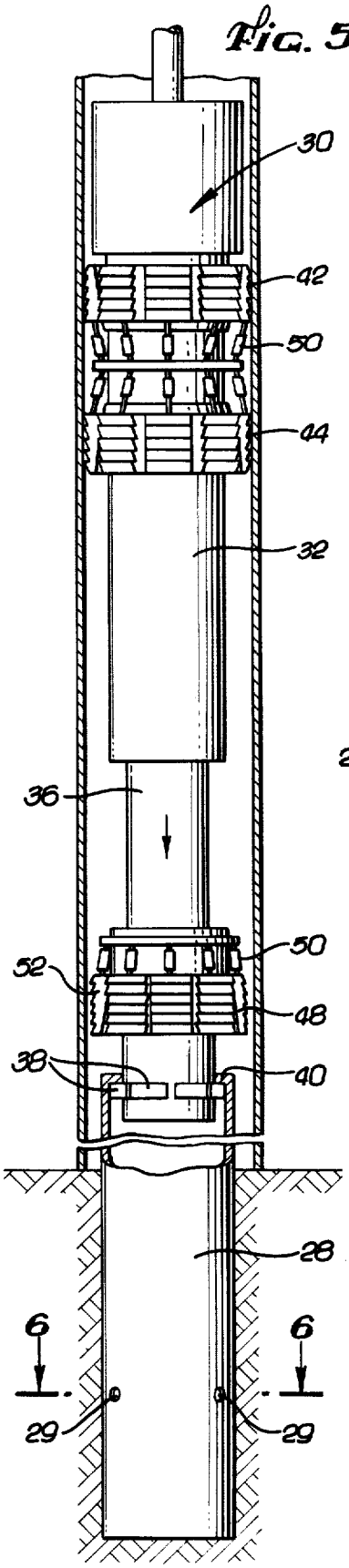
FIG. 5 is a cross-sectional view similar to FIG. 4 showing the jack in an extended position.

A hydraulic jack 30 is also positioned within each column 20 just above the corresponding pile 28 (see FIGS. 4 and 5). Each jack 30 includes a cylinder 32 within which a piston (not shown) is reciprocable along the generally vertical axis of the corresponding column 20. A rod 36 that extends from the bottom end of the piston engages the top of the pile 28 to exert downward pressure. The rod 36 fits into the top end of the pile 28 and hydraulically retractable dogs 38 on the bottom of the rod engage the underside of a radially inwardly extending flange 40 on the top of the pile 28 so that the piston can exert an upward force on the pile. Thus, exemplary jacks 30 might have an adjustable jacking speed of up to three feet per minute, with a force of up to 1700 tons over an eight foot stroke, while being extended or contracted.

At the top end of each jack 30 are two sets of top slip mechanisms 42 and 44. The upper top set 42 releaseably secures the top (cylinder end) of the jack 30 to the inside surface of the corresponding column 20 to prevent downward movement of the jack 30. The lower top set 44 prevents upward movement.

Each slip mechanism 42 or 44 consists of a ramp 46 immovably secured to the outside of the cylinder 32 and a wedge 48 that fits between the ramp and the inside of the column 20. A small hydraulic cylinder 50 forces the wedge 48 between the ramp 46 and the surface of the column 20 when actuated to cause frictional engagement, thereby immobilizing the cylinder 32 at any desired location.

Figure 7:
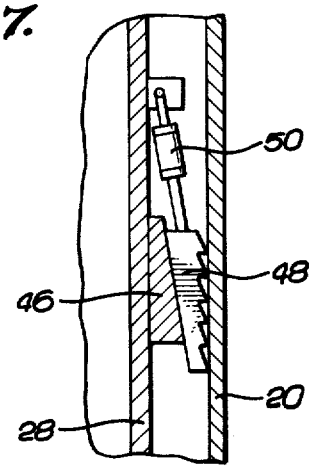
FIG. 7 is an enlarged cross-sectional view of one of the slip mechanisms indicated by the arrow 6—6 in FIG. 4.

At the bottom of the rod 36 is a similar set of slip mechanisms 52. These slip mechanisms 52 are oriented to prevent downward movement of the rod 36. They include basically the same arrangement of ramps 46, wedges 48 and hydraulic cylinders 50, as shown in FIG. 7.

Figure 9:
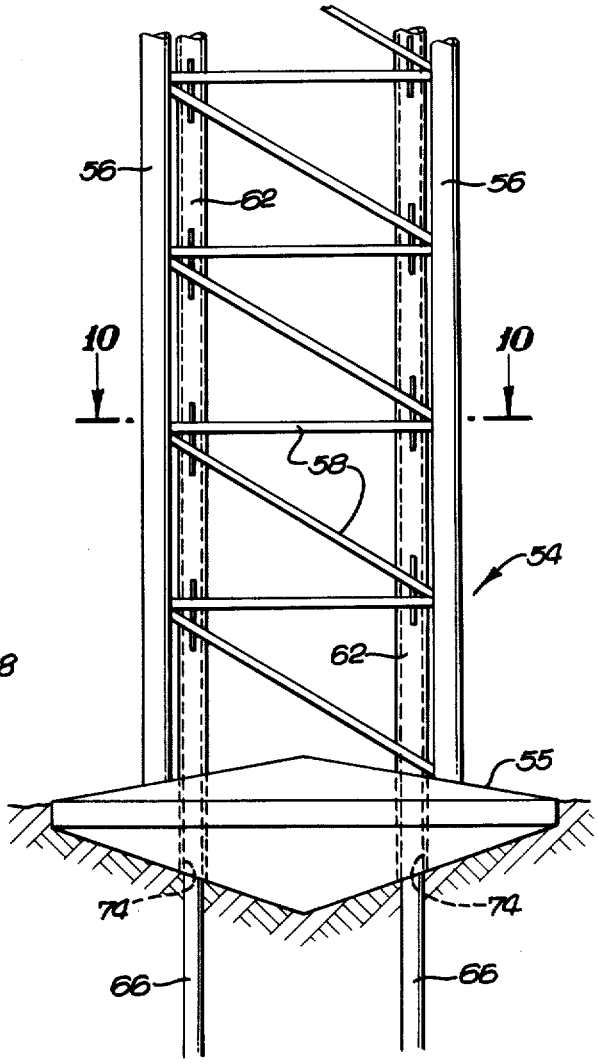
FIG. 9 is a side elevation of the bottom end of a leg of an alternative embodiment.
Figure 10:
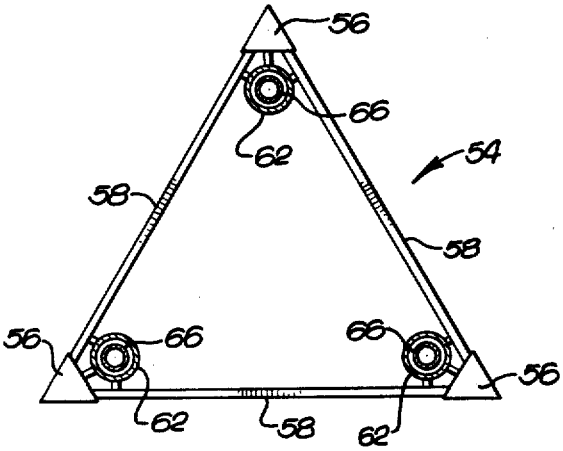
FIG. 10 is a horizontal cross-sectional view of a leg (similar to FIG. 3) of an alternative embodiment.

An alternative leg construction 54, shown in cross-section in FIGS. 9 and 10, is characteristic of a previously existing jack-up rig that has been modified to incorporate the present invention. Accordingly, spud cans 55 are attached to the bottom ends of the legs 54. These spud cans 55 are larger than the feet 24 described above, and extend well beyond the width of the leg 54 itself, although the spud cans 55 are generally not necessary to the practice of this invention, the smaller feet 24 being adequate.

As in the case of the first leg construction 14, the legs 54 each include three load-bearing columns 56 connected by truss members 58. The leg 54 also includes three separate pile guides 62 each extending along one of the columns 56 inside the truss members 58. An arrangement of piles 66 and hydraulic jacks and slip mechanisms (not shown) is disposed within the guides 62, as in case of the first leg 14. The spud cans 55 can be adapted for use with the invention by providing them with vertical openings 74 aligned with the guides 62 so that the piles 66 can pass through the spud cans into the ocean floor.

Figure 11:
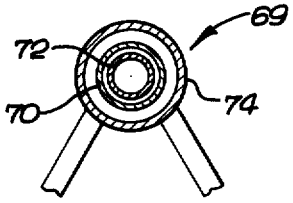
FIG. 11 is a fragmentary cross-sectional view of a leg of still another alternative embodiment.

It is necessary to position the pile guides 62 outside the columns 56 because of obstructions (not shown) that would prevent the cylinders from moving vertically within the columns. In some pre-existing rigs, however, it may be possible to use a leg construction 69 in which the load bearing columns act as pile guides, as in the leg construction 14. In other rigs, tubular pile guides 70 piles 72 can be positioned within pre-existing columns 74 as shown in FIG. 11.

The method of using the rig 10 is basically the same regardless of which exemplary leg construction 14, 54 or 69 is chosen and will be explained with reference to the construction 12 of FIGS. 1–8. The rig 10 is towed to a preselected well site, where the legs are lowered until the feet 24 come to rest on the ocean floor 16. While the rig 10 is underway, the piles 28 are held in the columns 20 by the bottom slips 52, it being preferable not to hang the piles from the cylinders 32 and rely on the top slips 42 for this purpose.

Once the rig 10 arrives at the site, the deck 12 is jacked out of the water in the conventional manner, as is well known to those skilled in the art and need not be described here. The deck 12 may be positioned near the bottom of the legs 14 for shallow water, as in FIG. 8, or near the top of the legs, as in FIG. 1, for deep water. Whether the water is deep or shallow, it is not necessary to provide a ballast tank to be filled once the rig 10 has been positioned.

Since the columns 20 are pre-loaded with the piles 28 and each column has its own permanently installed jack 30, the rig 10 is ready to be anchored as soon as the legs 14 are lowered to the ocean floor. Thus, the weather window required for installation of the rig 10 is reduced to a minimum and the safety factor of the entire installation process is increased accordingly.

The piles 28 are pushed into the ocean floor 16 by extending the hydraulic jacks 30 from the position of FIG. 4 to the position of FIG. 5. As the jacks 30 are extended, they are held against upward movement within the columns 20 by the lower set of top slips 44 and against downward motion by the upper set of top slips 42. Next the slips 42 and 44 are released and the jacks 30 are contracted, while the rods 36 and the piles 28 are held against downward movement by the bottom slips 52. It is necessary to guard against uncontrollable downward movement since the piles 28 could sink rapidly under their own weight in soft soil.

The jacks 30 then are resecured to the columns 20 by reactivating the top slips 42 and 44, and the jacks are extended again to push the piles 28 further into the ocean floor 16. This procedure of expanding and contracting the jacks 30 is repeated until the desired pile penetration has been reached to provide the necessary bearing capacity. If a storm should arise when the jacking of the piles 28 has not been completed, the tower 10 can be secured to the piles and prevented from being lifted by wave motion by actuating the bottom slips 52.

Jacking the piles 28 into the ocean floor 16 has a number of advantages when compared to the conventional use of a hammer to drive the piles by impact. The piles 28 are not subjected to lateral movement due to bending or outward radial expansion. Therefore, the surrounding soil 16 maintains a tighter grip on the piles 28, producing greater holding power for each foot of penetration. In addition, the energy input is more effectively employed when the piles 28 are jacked hydraulically because the piles do not dissipate the energy by flexing. Moreover, the hydraulic jacks 30 operate effectively under water, whereas a conventional air or hydraulic hammer could not.

It will be noted that the force required to drive each pile 28 can be readily monitored and recorded, with precision, and compared to the penetration of the pile. This information gives an accurate indication of the bearing capacity of the pile 28, which can be computed continuously as the pile is driven. Pile penetration can be determined from the flow of hydraulic fluid in the jacks 30. One important advantage of these calculations is that they permit an on-site determination of the depth to which each pile 28 must be driven to obtain the bearing capacity required. The waste inherent in driving the piles 28 to predetermined depths, rather than until a desired bearing capacity has been attained, is thus eliminated.

It is also possible to periodically verify the bearing capacity of the piles 28. This is accomplished by slowly increasing the pressure of the jacks 30 on the piles 28 until small incremental movement of the piles is observed. If insufficient resistance is encountered, the pile 28 is then known to be inadequately supported by the soil below. Further required penetration can be calculated and subsequently obtained.

Although the rig 10 is intended for temporary installation, it can, unlike conventional jack-up rigs, be converted to permanent installation once the exploration of the area is completed. For permanent installation, the piles 28 should be grouted to the columns 20 or other pile guides.

A particularly important advantage of jacking the piles 28 into the ocean floor 16 is that the same jacking mechanisms 30 are used to withdraw the piles into the columns 20 or other pile guides when it is desired to remove the rig 10. First, however, water is forced out through the apertures 29, shown in FIG. 6, to loosen the piles 28. This jetting operation, which continues during the first stroke of the jacks 30 is desirable because a pile 28 that has been in place for a significant time may otherwise require an initial pull-out force of two to three times the push-in force.

The jacks 30 are positioned near the bottom ends of the columns 20 and are extended upwardly. The upper set 42 of top slip mechanisms is activated to secure the jacks 30 to the columns 20 and then the jacks are contracted to raise the piles 28. Since the piles 28 typically offer little resistance to being pushed back down, the jacks 30 should be secured to the columns 20 by the bottom slip mechanisms 52 before they are expanded to raise the piles by another stroke. After the jacks 30 have been extended again, and resecured to the columns 20 at their top ends to prevent upward movement, the piles 28 are raised another stroke, and this process is repeated until the piles have been fully withdrawn into columns 20.

It is preferable that the jacks 30 always be actuated in sets that apply a balanced load to the rig 10. If an unbalanced load were applied, the piles 28 would tend to bend and bind against the soil, making penetation or withdrawal more difficult. In the case of the three-legged rig 10, one pile at each leg 12 should be part of each set. The tower described here would thus have three sets of piles 28, each set including one pile at each leg 14. Of course, the number of sets would vary with the number of piles 28 at each leg 14.

In the case of a four-legged rig (not shown), it is not necessary to move piles at all four legs simultaneously. Instead, balanced loads can be produced by moving piles at diagonally opposite legs.

It will be appreciated that the invention permits temporary rigs to be held by piles, giving them stability and safety previously possible only with permanent towers. At the same time, the rig of the invention is easily and quickly anchored and removed in a manner not previously possible in the case of towers anchored by piles.

While a particular embodiment of the invention has been illustrated and described, it will be apparent that various modifications and changes can be made without departing from the spirit and scope of the invention.

I claim:

1. A method for anchoring off-shore rigs including a plurality of legs and a deck structure for oil and gas well exploration, said method comprising the steps of:

(a) transporting said rig to a selected off-shore location;

(b) positioning said rig so that said legs extend upwardly from the ocean floor and support said deck above the water level, each of said legs including at least one pile guide extending therealong, a pile contiguous with said guide and a hydraulic jack within each of said guides above the corresponding one of said piles;

(c) securing said jacks to said legs at selected locations;

(d) extending said jacks and thereby driving said piles into the ocean floor;

(e) contracting said jacks and thereby causing said jacks to move downwardly along said guides, chasing said piles;

(f) repeating steps (a) through (e) until said piles have been driven far enough into said ocean floor to have the desired load-bearing capacity.

2. The method of claim 1 wherein said jacks are caused to engage said guides frictionally.

3. The method of claim 1 wherein said jacks are secured to said guides by actuating slip mechanisms whereby said guides are engageable at any selected location without vertical alignment.

4. A method for anchoring a temporary off-shore rig for oil and gas well exploration, said method comprising the steps of:

transporting said rig, including a plurality of legs and a deck structure, to a selected off-shore location where the water depth is between 30 and 400 feet;

positioning said rig so that said legs extend upwardly from the ocean floor and support said deck, each of said legs including a plurality of pile guides extending therealong, a pile within each of said guides and a hydraulic jack within each of said guides above a corresponding one of said piles;

securing at least some of said jacks to corresponding ones of said guides to prevent upward movement of said jacks;

extending said jacks and thereby driving said piles into the ocean floor;

contracting said jacks and thereby causing said jacks to move downwardly along said guides, chasing said piles;

resecuring said jacks to the corresponding ones of said guides; and again extending said jacks and thereby driving said piles farther into the ocean floor.

5. A method of anchoring and then removing a temporary off-shore rig for oil and gas well exploration, said rig including a deck structure and a plurality of legs, each leg having at least one pile guide containing a pile and a hydraulic jack, said method comprising the steps of:

(a) towing said rig to a selected off-shore location where the water depth is between 30 and 400 feet;

(b) lowering said legs relative to said deck and thereby causing said legs to come to rest on the ocean floor and raising said deck above the water level;

(c) securing at least some of said jacks to the corresponding ones of said guides to prevent upward movement of said jacks;

(d) extending said jacks and thereby driving piles into the ocean floor;

(e) contracting said jacks and thereby causing said jacks to move downwardly along said guides, chasing said piles;

(f) repeating steps (c) through (e) until said piles have been driven far enough into said ocean floor to have the desired load-bearing capacity;

(g) later securing said jacks to said guides to prevent downward movement thereof;

(h) contracting said jacks and thereby lifting the corresponding ones of said piles;

(i) extending said jacks and thereby causing said jacks to move upwardly along said guides ahead of said piles;

(j) repeating steps (g) through (i) until said piles have been withdrawn from the ocean floor;

(k) raising said legs relative to said deck, thereby lowering said deck to the water level and causing said tower to float; and (l) towing said tower to another location.

6. A method of anchoring and then removing a temporary off-shore rig for oil and gas well exploration, said rig including a deck structure and a plurality of legs, each leg having at least one guide containing a pile and hydraulic jack and slip mechanisms for causing and preventing movement of said pile within said guide, said method comprising the steps of:

(a) towing said rig to a selected off-shore location where the water depth is between 30 and 400 feet, said piles being held within said guides by said slip mechanisms as said rig is towed;

(b) lowering said legs relative to said deck and thereby causing said legs to come to rest on the ocean floor and support said deck above the water level;

(c) extending said jacks and thereby driving said piles into the ocean floor while using said slip mechanisms to prevent said jacks from moving upwardly within said guides;

(d) contracting said jacks and thereby causing said jacks to move downwardly along said guide, chasing said piles;

(e) repeating steps (c) and (d) until said piles have been driven far enough into said ocean floor to have the desired load-bearing capacity;

(f) later, jetting water from said piles to loosen said piles;

(g) contracting said jacks and thereby pulling said piles upwardly into said guides while using said slip mechanisms to prevent said jacks from moving downwardly within said guides;

(h) extending said jacks while using said slip mechanisms to prevent downward movement of said piles and thereby causing said jacks to move upwardly along said guides ahead of said piles;

(i) repeating steps (g) and (h) until said piles have been withdrawn from the ocean floor;

(j) raising said legs relative to said deck and thereby lowering said deck to the water level and causing said legs to be lifted off the ocean floor; and (k) towing said tower to another location.

7. The method of claims 5 or 6 wherein said water continues to flow outwardly through said apertures during the first performance of step (h).

8. The method of claim 1 wherein selected jacks corresponding to more than one leg are actuated simultaneously to balance the forces acting on said rig.

9. The method of claim 5 further comprising the step of causing water to flow outwardly through apertures in said piles under pressure in preparation for lifting said piles.

10. The method of claim 5 wherein said jacks are extended and contracted in sets, each set including at least one jack at each of said legs, thereby balancing the forces acting on said rig.

11. The method of claim 5 further comprising monitoring the jacking force required to drive said piles and the amount of pile penetration.

12. The method of claim 6 further comprising monitoring the jacking forces required to drive said piles and the amount of pile penetration.

* * * * *